United States Patent [19]

Stedman

[11] 4,053,016

[45] Oct. 11, 1977

[54] MOTOR GRADER BLADE LIFT AND CONTROL MECHANISM AND METHOD

[75] Inventor: Robert N. Stedman, Chillicothe, Ill.

[73] Assignee: Caterpillar Tractor Co., Peoria, Ill.

[21] Appl. No.: 720,859

[22] Filed: Sept. 7, 1976

[51] Int. Cl.[2] ..... E02F 3/76

[52] U.S. Cl. ..... 172/1; 172/791; 172/797

[58] Field of Search ..... 172/1, 781, 789, 791, 172/795, 797, 803, 807

[56] References Cited

U.S. PATENT DOCUMENTS

| | | | |
|---|---|---|---|
| 1,922,880 | 8/1933 | Carswell et al. | 172/797 |
| 3,164,915 | 1/1965 | Benner et al. | 172/797 |
| 3,677,350 | 7/1972 | Johnson et al. | 172/789 |

*Primary Examiner*—Paul E. Shapiro
*Attorney, Agent, or Firm*—Phillips, Moore, Weissenberger, Lempio & Majestic

[57] ABSTRACT

A motor grader comprises a frame having a circle drawbar mounted thereunder. A normally horizontally disposed mold board or blade is attached to the circle drawbar for multi-directional movements relative thereto and relative to the frame of the motor grader. A pair of generally vertically disposed hydraulic cylinders have their rod ends pivotally connected to the circle drawbar and their housings universally connected to a pair of indexing discs rotatably mounted on either side of the frame. A detent is reciprocally mounted on the frame to engage one of a plurality of circularly disposed recesses formed in each indexing disc. A first link is pivotally interconnected between the frame and a second link which is further pivotally connected to the circle drawbar. A cylinder is pivotally interconnected between the circle drawbar and the first link whereby the blade may be side shifted and disposed substantially vertically on either side of the frame. A motor may be mounted on the frame to selectively rotate each of the indexing plates and the detent may be selectively retracted, also under control of the operator.

22 Claims, 6 Drawing Figures

MOTOR GRADER BLADE LIFT AND CONTROL MECHANISM AND METHOD

BACKGROUND OF THE INVENTION

A conventional motor grader comprises a frame having a circle drawbar suspended therebelow by a pair of links and attendant support struts. A mold board or blade is mounted beneath the circle drawbar and means are normally provided for lifting, tipping, shifting and rotating the mold board to position it for various grading operations. Various attempts have been made to provide means for side shifting the blade from its normal horizontal disposition at ground level to a generally vertical disposition alongside the frame of the motor grader.

The latter disposition of the blade facilitates side bank cuts and the like to thus substantially increase the overall versatility of the motor grader. To date, the lift and control mechanism employed to effect such shifting of the blade have proved unduly complex and costly to manufacture. In addition, the motor grader frames and attendant structures tend to interfere with such side shifting of the blade to prevent it from being moved substantially vertically.

SUMMARY OF THIS INVENTION

An object of this invention is to provide an improved lift and control mechanism for a motor grader blade which is relatively non-complex and exhibits a high degree of structural integrity. The blade is adapted for multi-directional movements, including movement to either side of the motor grader to place it in a vertically disposed position for performing left or right side bank cuts.

The motor grader comprises a main frame having a sub-frame, such as a circle drawbar, pivotally attached thereto. The normally horizontally disposed mold board or blade is attached to the sub-frame and lifting means are provided for connecting the sub-frame to the main frame for swinging the blade to its generally vertically disposed positions on either side of the main frame. An indexing means is rotatably mounted on each lateral side of the main frame. An extensible and retractable actuating means of the lifting means is pivotally connected to each indexing in offset relationship relative to a rotational axis thereof whereby the actuating means can be moved vertically relative to the main frame to facilitate such vertical disposition of the blade.

BRIEF DESCRIPTION OF THE DRAWINGS

Other objects of this invention will become apparent from the following description and accompanying drawings wherein.

DETAILED DESCRIPTION

Figure 1:
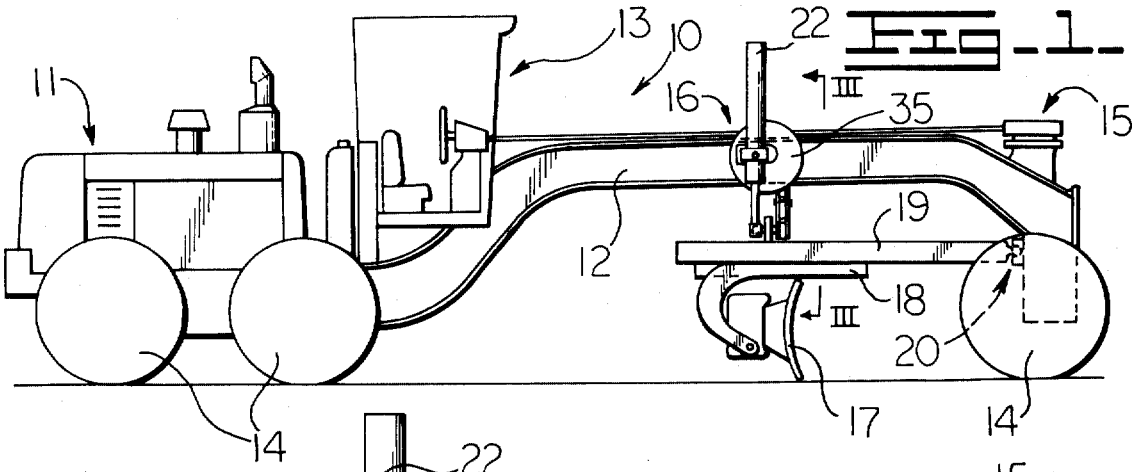
FIG. 1 is a side elevational view of a motor grader having the lift and control mechanism of this invention mounted thereon.

FIG. 1 illustrates a motor grader 10 comprising a tractor portion 11 having a main frame 12 extending forwardly therefrom. An operator's cab 13 is mounted on the frame and the frame is supported on three pairs of ground engaging road-wheels 14. A conventional steering gear and valve arrangement 15 is mounted on a forward end of the frame to selectively steer the front roadwheels under control of the operator.

Figure 2:
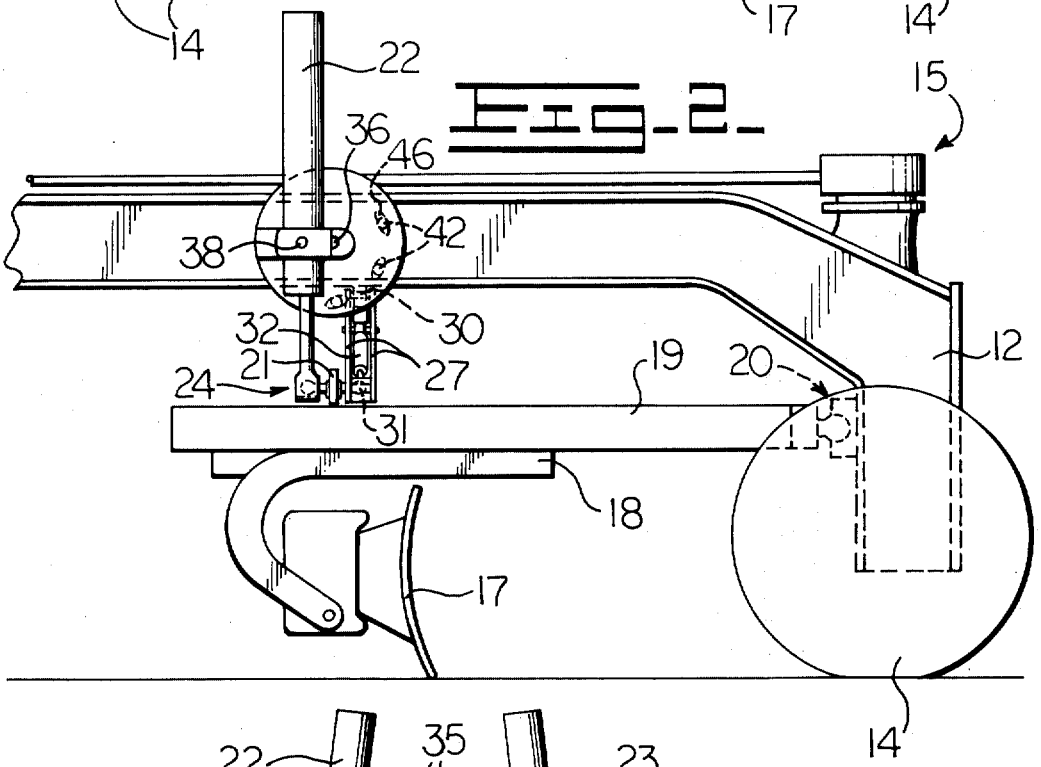
FIG. 2 is an enlarged side elevational view of a forward portion of the motor grader, showing the lift and control mechanism supporting a circle drawbar and mold board thereunder.
Figure 3:
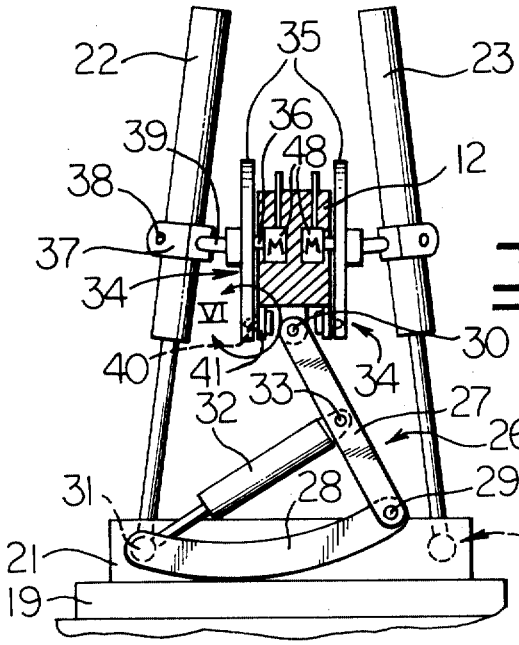
FIG. 3 is a front elevational view of the lift and control mechanism, taken in the direction of arrows III—III in FIG. 1.

FIGS. 2 and 3 more clearly illustrate a lift and control mechanism 16 of this invention for selectively positioning a mold board or blade 17, under the control of the operator, to perform various cutting, grading and related construction operations. The blade is supported on a sub-frame preferably comprising a circle 18 and drawbar 19, in a conventional manner. In addition, suitable means, not shown, may be provided for side shifting and tipping the blade relative to the circle.

The forward end of drawbar 19 is pivotally connected for universal movement to a forward end of frame 12 by a ball and socket connection 20. A transversely disposed bracket 21 is secured on drawbar 19 for connecting the main frame thereto via mechanism 16. Such mechanism includes a pair of extensible and retractable actuating means 22 and 23, preferably double-acting hydraulic cylinders, normally generally vertically disposed on either side of the main frame and further disposed to diverge away from each other downwardly, as shown in FIG. 3.

The rod ends of cylinders 22 and 23 are pivotally connected for universal movement to opposite ends of bracket 21 by ball and socket connections 24 and 25. A linkage means 26 comprises first and second links 27 and 28 having first ends thereof pivotally connected together by a common pin 29. The second end of link 27 is pivotally connected to a lug secured to an underside of main frame 12 by a pin 30. A second end of link 28 is pivotally connected to bracket 21 by a pin 31 which is located on the bracket, adjacent to ball and socket connection 24.

Linkage means 26 further comprises actuating means 32, also preferably comprising a double-acting hydraulic cylinder. The rod end of cylinder 32 is pivotally connected to common pivot pin 31 whereas the housing thereof is pivotally connected to link 27 by a pin 33 and intermediate the ends thereof.

An indexing means 34 is rotatably mounted about an axis thereof on each lateral side of main frame 12 and is universally connected to a respective cylinder 22 or 23. The indexing means primarily function to selectively raise or lower the cylinders relative to each other to adjust the vertical heights thereof for side bank cuts and the like. Each indexing means comprises a disc 35 rotatably mounted on the main frame by a shaft 36 and disposed in a vertical plane, parallel relative to the longitudinal axis of the frame.

As shown in FIG. 3, each shaft may be selectively rotated to a particular indexing position under control of the operator by a rotary hydraulic or electric motor. Alternatively, the discs could be rotated manually or by manipulating blade 17, as will be hereinafter explained. Cylinder 22, for example, is mounted for universal movements on one disc 36 by a yoke 37 pivotally connected to the housing of the cylinder by a cross-pin 38.

A pivot shaft 39 secured to the yoke and pivotally mounted in a conventional manner on the disc and in offset relationship relative to the rotational axis thereof.

Each indexing means 34 further comprises a detent 40 reciprocally mounted in a bracket 41 secured to the underside of main frame 12 and a plurality of recesses 42 formed in a circular pattern on the inboard side of the disc to alternately receive a tapered end of the detent therein. As shown in FIG. 2, recesses 42 are subscribed by a circle having its center coincident with the rotational axis of shaft 36. The detent and recesses thus provide detent means for holding the disc in a selected rotative position to raise or lower cylinder 22, for example.

Figure 6:
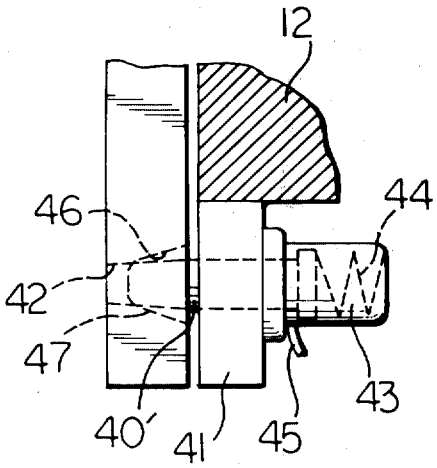
FIG. 6 is an enlarged and partially sectioned view illustrating a modified detent means employed in an indexing means of the lift and control mechanism.

Each detent may comprise a standard spring-loaded detent mechanism, a bolt or other suitable means for holding the disc in the selected rotative position relative to the main frame. For example, FIG. 6 illustrates a detent means wherein a detent 40′ is in the form of a piston reciprocally mounted in a housing 43, secured on bracket 41. A compression coil spring 44 is mounted in the housing to normally bias the detent into engagement with a respective recess 42 and a conduit 45 is connected to the housing to selectively pressurize or depressurize a working chamber thereof with air or hydraulic fluid to selectively retract the detent.

Suitable camming ramps 46 and 47 of conventional design may be formed on the inboard side of the disc, adjacent to circumferential sides of each aperture 42, to aid in automatically forcing the detent out of the recess (FIGS. 2 and 6). As suggested above, discs 35 can be rotated in unison or in opposite directions relative to each other by operator controlled motors 48 (FIG. 3). Alternatively, cylinders 22 and 23 can be alternately extended and retracted to force an end of blade 17 into engagement with the ground to create a reaction force which will index the discs in opposite rotative directions.

Figure 4:
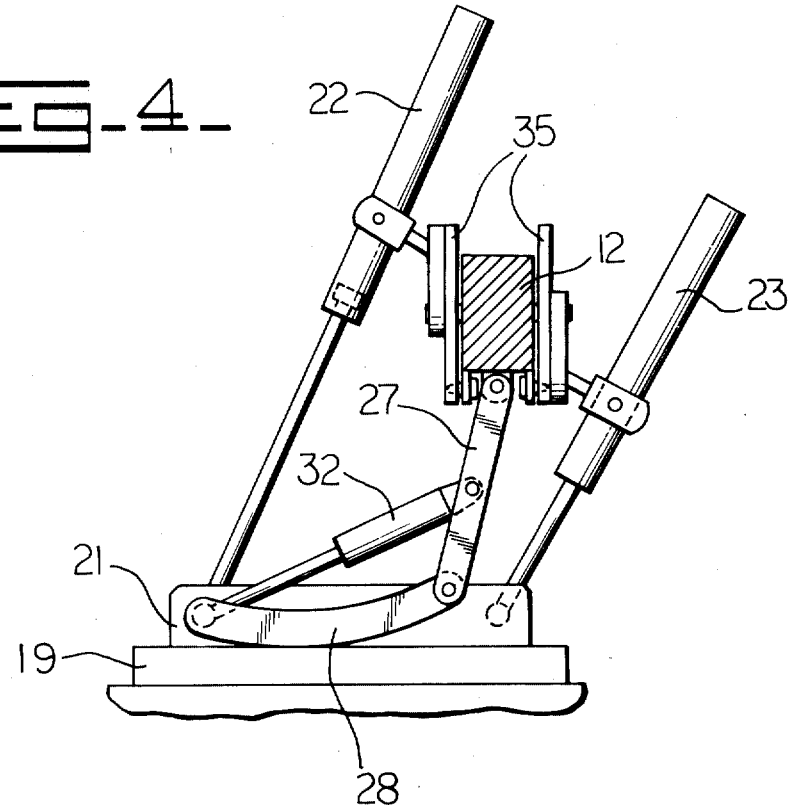
FIGS. 4 and 5 are views similar to FIG. 3, but illustrating the mold board moved to two positions of operation on the motor grader.
Figure 5:
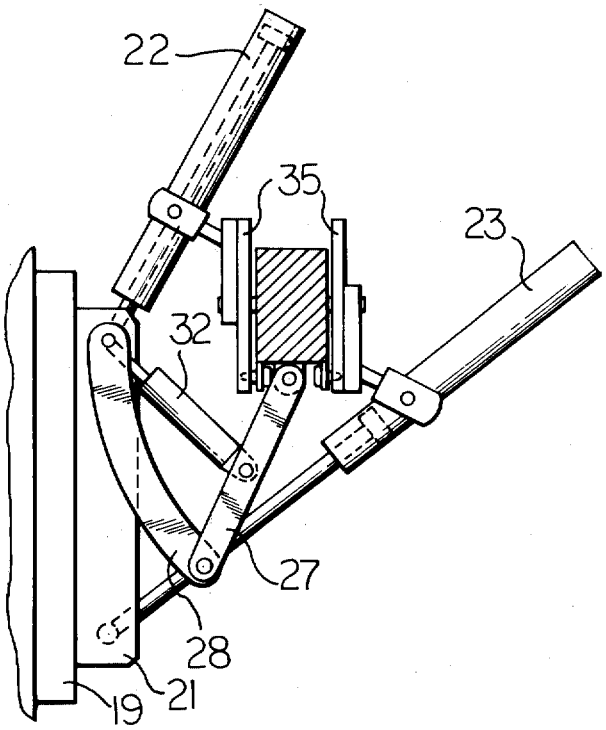

Blade 17 can be moved by suitable operator control means (not shown) through an infinite number of side shifted (FIG. 4) and/or tilted positions (FIG. 5) between its normally horizontally disposed position illustrated in FIGS. 1–3 and its vertically disposed position illustrated in FIG. 5. The blade can be side shifted and positioned for bank cuts (1) by placing cylinder 32 in a "float" condition of operation and selectively reciprocating cylinders 22 and 23 or (2) by placing cylinders 22 and 23 in "float" conditions of operation and selectively reciprocating cylinder 32.

In addition to the selective utilization of rotating motor means 48 for each disc 35 (FIG. 3), indexing means 34 can be rotated to raise or lower the related lift cylinders 22 or 23— by applying hydraulic pressure to the head-end of either or both cylinders 22 and 23 to force blade 17 against the ground, thereby causing the disc connected to the activated cylinder(s) to rotate the associated yoke 37 upwardly. Alternatively, when hydraulic pressure is directed to the rod-end of cylinder 22 or 23, the blade will be raised above the ground level and the natural forces of gravity will cause disc 35 to rotate and yoke 37 to move in a downward direction. Upon rotation of each disc 35, it should be noted that the cylinder attached thereto is moved in a vertical plane, parallel to the longitudinal axis of main frame 12. It should be understood that detent 40 must be withdrawn from recess 42 formed in disc 35 to free the disc for the described rotational movement, and then be repositioned in the recess when the predetermined disc position is attained, thereby locking the disc 35 relative to the frame 12.

What is claimed is:

1. A motor grader comprising
a forwardly extending main frame,
a sub-frame pivotally attached to said main frame,
a normally horizontally disposed blade attached to said sub-frame,
lifting means, including a pair of extensible and retractable actuating means disposed on either side of said main frame, connecting said sub-frame to said main frame for swinging said blade from its normal horizontal position to a generally vertical position on either side of said main frame, and
indexing means rotatably mounted about an axis thereof on each lateral side of said main frame and wherein a respective one of said actuating means is pivotally connected to said indexing means in offset relationship relative to the rotational axis thereof for selectively raising or lowering said actuating means vertically relative to said main frame.

2. The motor grader of claim 1 wherein said sub-frame is universally connected to a forward end of said main frame.

3. The motor grader of claim 1 wherein said sub-frame constitutes a circle drawbar.

4. The motor grader of claim 1 further comprising a pair of steerable roadwheels mounted on a forward end of said main frame and steering gear and valve means mounted on the forward end of said main frame for selectively steering said roadwheels.

5. The motor grader of claim 1 wherein said lifting means comprises linkage means pivotally interconnected between said main frame and said sub-frame.

6. The motor grader of claim 5 wherein said linkage means comprises first and second links pivotally connected together at first ends thereof and wherein a second end of said first link is pivotally connected to said main frame and a second end of said second link is pivotally connected to said sub-frame.

7. The motor grader of claim 6 wherein said linkage means further comprises a double-acting hydraulic cylinder pivotally interconnected between said first link and said sub-frame.

8. The motor grader of claim 7 wherein said cylinder is pivotally connected to said first link intermediate the ends thereof and is pivotally connected to said sub-frame at a common pivot pivotally connecting the second end of said second link thereto.

9. The motor grader of claim 1 wherein said pair of extensible and retractable actuating means each constitute a double-acting hydraulic cylinder.

10. The motor grader of claim 9 wherein each of said indexing means comprises a disc rotatably mounted on said main frame and having a respective one of said cylinders universally mounted thereon.

11. The motor grader of claim 10 wherein said disc is disposed in a vertical plane parallel to a longitudinal axis of said main frame.

12. The motor grader of claim 11 further comprising retractable detent means operatively associated between said main frame and each said disc for holding said disc in a selected rotative position relative to said main frame.

13. The motor grader of claim 12 wherein said detent means comprises a detent movably mounted on said main frame and a plurality of recesses formed on said disc in a circular pattern thereon.

14. The motor grader of claim 12 wherein said detent means comprises a detent forming a piston reciprocally mounted in a housing secured to said main frame and means for communicating pressurized fluid to a working chamber of said housing to move said detent axially in said housing.

15. The motor grader of claim 4 wherein said detent means further comprises spring means disposed in said housing and normally biasing said detent into engagement with a respective one of said recesses.

16. The motor grader of claim 1 wherein said pair of extensible and retractable actuating means each comprise a double-acting hydraulic cylinder.

17. The motor grader of claim 16 wherein said lifting means comprises linkage means, including another double-acting hydraulic cylinder, pivotally interconnected between said main frame and said sub-frame whereby said control circuit means may be conditioned for (1) placing said first mentioned cylinders in a "float" condition of operation whereby said another cylinder may be selectively extended or retracted to shift said sub-frame and blade or (2) placing said another cylinder into a "float" condition of operation whereby said first mentioned cylinders may be selectively extended or retracted to shift said sub-frame and blade.

18. A method for moving and simultaneously indexing a blade which is suspended under a frame of a construction vehicle by at least one double-acting cylinder interconnected between a disc rotatably mounted on said frame and said blade comprising the steps of rotating said disc to a selected rotative and indexed position on said frame while simultaneously moving said cylinder in a vertical plane disposed at least substantially parallel relative to a longitudinal axis of the frame of said vehicle.

19. The method of claim 18 wherein said rotating step comprises rotating said disc by a motor means.

20. The method of claim 18 wherein said rotating step comprises extending said cylinder to engage said blade with ground level to apply a force on said disc to rotate the same.

21. The method of claim 18 wherein said rotating step comprises retracting said cylinder to raise said blade above ground level and permitting natural forces of gravity to rotate said disc.

22. The method of claim 18 further comprising the step of rotating another disc, rotatably mounted on said frame and connected to said blade by another double-acting cylinder.

* * * * *